United States Patent [19]

Babcock et al.

[11] Patent Number: 4,876,287

[45] **Date of Patent: * Oct. 24, 1989**

[54] SELECTIVE ION-COMPLEXING MEDIA FOR THE REMOVAL OF METAL-ION CONTAMINANTS FROM PLATING BATHS

[75] Inventors: Walter C. Babcock; Dwayne T. Friesen, both of Bend, Oreg.

[73] Assignee: Bend Research, Inc., Bend, Oreg.

[ * ] Notice: The portion of the term of this patent subsequent to Nov. 11, 2003 has been disclaimed.

[21] Appl. No.: 929,005

[22] Filed: Nov. 10, 1986

Related U.S. Application Data

[62] Division of Ser. No. 642,419, Aug. 20, 1984, Pat. No. 4,702,838.

[51] Int. Cl.[4] ..... C08D 5/20

[52] U.S. Cl. ..... 521/28; 521/27; 524/236; 524/417

[58] Field of Search ..... 524/236, 417; 521/27, 521/28

[56] References Cited

U.S. PATENT DOCUMENTS

| | | | |
|---|---|---|---|
| 4,317,804 | 3/1982 | Ichijo | 423/139 |
| 4,515,906 | 5/1985 | Friesln et al. | 521/28 |
| 4,622,344 | 11/1986 | Babcock et al. | 521/28 |

*Primary Examiner*—Joseph L. Schofer
*Assistant Examiner*—Peter F. Kulkosky
*Attorney, Agent, or Firm*—Chernoff, Vilhauer, McClung & Stenzel

[57] ABSTRACT

Ion-complexing gels are disclosed for the selective removal of metal ions from plating solutions, the gels comprising hydrophobic nonporous polymers plasticized and swollen with either hydroxyoxime or phosphoric acid ester complexing agents. Also disclosed are novel ion-complexing media comprising polymeric microporous anisotropic beads impregnated with the same complexing agents. Copper, zinc and iron contaminants are effectively removed from nickel-plating solutions.

18 Claims, 2 Drawing Sheets

1000 MICRONS

SELECTIVE ION-COMPLEXING MEDIA FOR THE REMOVAL OF METAL-ION CONTAMINANTS FROM PLATING BATHS

This is a divisional application of Ser. No. 642,419, filed Aug. 20, 1984 now U.S. Pat. No. 4,702,838.

BACKGROUND OF THE INVENTION

Contamination of metal-plating baths by impurity-metal ions is a common problem in the plating industry. One source of the contaminants is the metal parts being plated. Oxidation of the surface layers of these parts during surface cleaning can lead to dissolution of metal ions from the parts and into the plating solution. Contamination also arises from adherence of previous plating solution to the surface of parts that are to be further plated.

A notable example is copper and zinc contamination of nickel-plating baths, in both electrolytic and electroless plating. Concentrations of only about 20 ppm and less of these contaminating metals adversely affect plating quality and so are generally regarded as unacceptable. Iron contamination of nickel-plating baths is also common, although iron concentrations of up to 100 ppm can be reached before there is a serious effect on nickel-plating quality if water soluble ion-chelating compounds are added to the plating solution.

It is exceedingly difficult to remove contaminating metal ions from electroplating solutions without also removing large amounts of the metal being plated. With nickel-plating again as the example, the principal methods of removing copper and zinc contaminants from electrolytic nickel-plating solutions have been variations of a basic method known as "dummying," wherein, for example, a "dummy" cathode with a corrugated surface is placed in the bath and the current density is reduced to very low levels to preferentially plate out the unwanted copper and zinc onto the cathode, which is eventually discarded. Dummying as a decontamination technique has inherent disadvantages, however. It has extremely poor selectivity for copper and zinc over nickel, removing 20 to 500 times as much nickel as copper or zinc, thus requiring replacements of substantial amounts of nickel in the plating bath. Because of the very low current densities required, dummying is an inherently slow process, typically requiring up to sixteen hours of downtime, during which plating of parts cannot be accomplished, and so productivity is lost.

Iron is usually removed by filtration of the solution when it begins to precipitate from the bath as iron hydroxide. However, it would be desirable to remove the iron as an ion before it precipitates, since the presence of iron hydroxide in the plating solution can cause degradation in plating quality.

A possible method for removing trace metal-ion impurities from nickel-plating baths is with the conventional ion-exchange materials. Such a method would have an advantage over dummying in that it could be used simultaneously with the plating of parts, thereby eliminating the loss of productivity associated with dummying. Unfortunately, conventional ion-exchange resins are not sufficiently selective, and a major disadvantage of dummying—loss of nickel from the bath—would still exist.

Another possible method of simultaneously removing trace metal-ion impurities from nickel-plating baths while parts are being plated is with organic liquid ion-exchange agents. These agents can be highly selective, and their use in the removal of metal ions from aqueous solutions is known. In U.S. Pat. No. 3,682,589 to Moore, there is disclosed the selective removal of copper, nickel, iron and cobalt from concentrated zinc sulphate solutions by the use of oxime complexing agents adsorbed onto activated charcoal. Wallace, in U.S. Pat. No. 4,108,640, describes the hydrometallurgical separation of nickel from cobalt by liquid-liquid extraction with organic complexing agents. In *Hydrometallurgy* 3(1976)65; Kauczor et al. disclose the removal of zinc from cobalt sulphate solutions by the use of a phosphoric acid ester-containing isotropic styrene-divinylbenzene copolymer resin. In *Int. Chem E. Sym.*, Series No. 42, Kroebal et al. describe recovery of uranium from nitric acid solution with tributylphosphate in Levextrel® resin. Warshawsky discusses the recovery of zinc, copper, and uranium from hydrometallurgical solutions with similar resins in *Trans. Inst. Min. Metall.* (Section C: Mineral Process. Extractive Metall.) 83 (1974). However, no suggestion of metal-ion contaminant removal from metal-plating baths with liquid ion-exchange agents has been made in prior work, either by liquid-liquid extraction or with the agent held in microporous media.

There are several possible reasons for this omission. One is that the conventional method of controlling the selectivity of organic liquid ion-exchange agents for one metal ion over another is to adjust the solution variables such as ionic strength, pH, and temperathure. However, in plating solutions these variables must be maintained within a narrow range to permit high-quality plating. There are also potential drawbacks to using the agents in conjunction with plating baths. Organic additives in plating baths which act as plating brighteners can be extracted into the organic agent phase and thus cause degradation in plating quality. Also, problems may arise due to loss of the liquid ion-exchange agent itself. This is particularly true in the case of nickel-plating baths in which organic compounds in the solution (other than brighteners) can cause plating defects such as darkened plate or pitting, and so great care must be taken to avoid such contamination. If, however, these obstacles could be overcome, thereby permitting advantage to be taken of the high selectivity of the organic liquid ion exchange agents, their use would represent a substantial improvement to currently practiced methods of removing metal-ion contaminants from plating baths.

SUMMARY OF THE INVENTION

According to the present invention, there are provided novel ion-complexing media for the highly selective removal of metal-ion contaminants from plating solutions and especially for removal of copper, zinc and iron from nickel-plating solutions. The ion-complexing media comprise essentially two types: gels that are hydrophobic nonporous polymers plsticized and swollen with hydroxyoximes and phosphoric acid esters; and microporous polymeric material, especially in the form of beads with anisotropic pore structures impregnated with hydroxyoximes and phosphoric acid esters. Three forms of the gels are preferred: (1) unsupported gel; (2) porous media impregnated with gel; and (3) porous media impregnated with agent and coated with agent-swollen gel. Unexpectedly, even though the organic complexing agents are slowly lost to the plating bath, the resulting contamination has little or no adverse effect on the quality of plating from the solution.

DETAILED DESCRIPTION OF THE INVENTION

Highly selective removal of copper ions from nickel plating solutions with little or no adverse effect upon plating may be accomplished by contacting such solutions with hydroxyoxime complexing agents generally of the formula

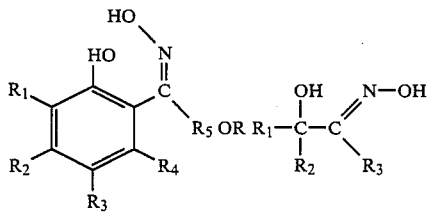

wherein R is selected from hydrogen, alkyl and aryl and $R_1$ is selected from hydrogen, alkyl, aryl and CH=N—OH; and $R_2$, $R_3$, $R_4$ and $R_5$ are selected from hydrogen, alkyl and aryl. Generally, the useful hydroxyoximes include alkyl alpha-hydroxyoximes and aromatic beta-hydroxyoximes. Specific examples include 2-hydroxy-5-alkyl benzaldehyde oximes; 2-hydroxy alkylbenzophenone oximes; 2,6-diformyl-4-alkylphenol dioximes; and 5,8-diethyl7-hydroxydodecane-6-one oxime.

For effective removal of copper to less than 10 ppm, the oxime may be present in substantially pure form or in a hydrocarbon diluent at concentrations as low as 5 vol%. Effective removal of copper occurs with plating solution pHs of from about 3 to about 5.5, preferably 3.5 to 4.5, and at a temperature from about 20° C. to about 80° C.

Zinc and iron are selectively removed from nickel-plating solutions to concentrations of less than 10 ppm by contact of the solution with phosphoric acid esters of the general formula

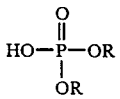

wherein R is selected from hydrogen, alkyl and aryl, and at least one R is alkyl or aryl. Examples include di-2-ethylhexyl phosphoric acid, di-2-ethyloctylphosphoric acid, di-iso-decyl phosphoric acid, di-n-decyl phosphoric acid, di-(3,7-dimethyloctyl) phosphoric acid, and di-alkylphenyl phosphoric acid. Decontamination of zinc- or iron-contaminated plating solutions may be accomplished at pH 3 to 5.5, ideally at 3.5 to 4.5, at a temperature of from about 20° C. to about 80° C., and with pure esters or esters diluted in hydrocarbon diluents at concentrations as low as 5 vol%.

Figure 1:
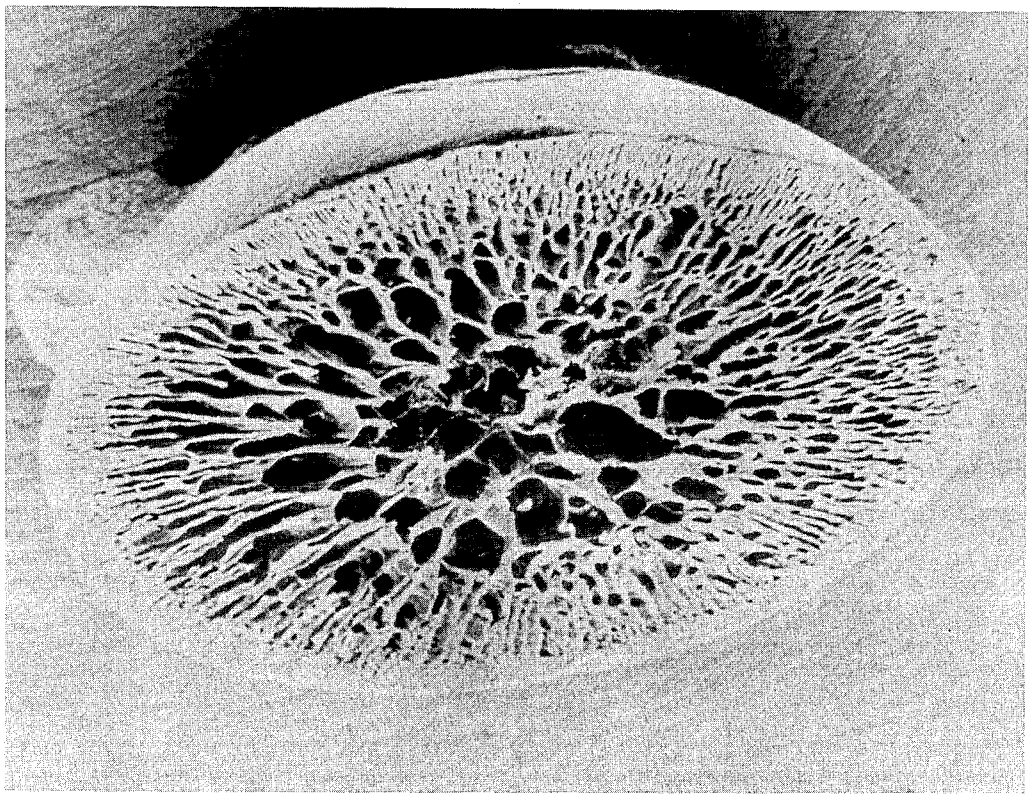
FIG. 1 is a photograph by a scanning electron microscope of a cross section of suitable microporous polymeric support for the liquid ion-exchange agents of the present invention.

For ease of operation in the treatment of plating solutions, the oxime and phosphoric acid ester complexing agents may be incorporated into a polymeric microporous material in forms such as beads, sheets or fibers. Fibers should be from about 0.2 mm to about 2 mm in diameter, and in lengths of from about 2 cm to about 50 cm. Flat sheets should be approximately 0.2 mm to 2 mm thick. An especially suitable form comprises generally spherical-shaped beads with anisotropic pore structure, said beads having diameters from about 0.5 to about 5 mm and having surface pores less than 0.1 micron in diameter, and interior pores from about 10 to about 200 microns in diameter. FIG. 1 is a photomicrograph of an exemplary bead in cross section. Suitable polymers from which the anisotropic microporous materials are made include polysulfones, polyethylenes, polyamides, polymethacrylates, and polystyrenes.

Anisotropic microporous beads of the present invention are made by injecting droplets of a solution of the polymer through a stainless steel tube into a water bath at a temperature of from 0° C. to 50° C. where they are precipitated, the precipitation occurring more rapidly at the exterior surfaces than the interior, causing anisotropy with a graduation of pore sizes from very small (less than 0.1 micron) on the exterior to relatively large (100 to 200 microns) at the center. Bead size may be varied between about 2 mm to about 5 mm by varying the tube diameter. The preferred size is 2 to 3 mm in diameter. After precipitation, the beads may be washed with water and air-dried.

Suitable fibers are made by injecting a continuous stream of polymer solution through a stainless steel tube into a water bath under conditions substantially similar to those used to fabricate beads.

Flat sheets are made by conventionally practiced casting procedures used in the production of microporous polymeric membranes as disclosed, for example, in *Adv. Chem. Serv.* 38(1962)117, U.S. Pat. No. 3,651,024 and *Polym. Let.* 11(1973)102.

Alternatively, the oxime and phosphoric acid ester complexing agents may be incorporated into gels comprising hydrophobic nonporous polymers that are plasticized and swollen with the oxime and phosphoric acid ester agents.

Plasticization of polymers is well known and can generally be said to be accomplished when an organic liquid is mixed with the polymer to yield a homogeneous rubbery texture with the polymer having a lower glass transition temperature than prior to addition of the organic liquid. The glass transition temperature of a polymer is susceptible to objective measurement by a number of means, such as differential scanning calorimetry (DSC), softening point measurements and light scattering measurements. The swelling of a polymer with a liquid agent is not as susceptible to objective measurement as plasticization, but generally comprises an expansion in volume accomplished by a takeup of at least 50 weight percent of liquid agent.

When the metal complexing agents are used to both plasticize and swell hydrophobic nonporous polymers, the agent and polymer become integrated into an essentially homogeneous gel that has the metal ion-extraction properties of the agent, the immobilizing and tensile strength properties of the polymer and the new unexpected combined properties of far superior agent retention, the ability to resist solution entrainment and therefore the ability to exclude impurities as well.

Typical hydrophobic nonporous polymers useful in the ion-exchange gels of the present invention include alkyl-, aryl-, halogen- and amino-substituted polyethylenes, polypropylenes, polyacrylics, polyacrylates, polymethacrylates, polyurethanes, polyamides, polyetherimides, polyvinylbutyrals, polyacrylonitriles, polynorborenes, polyvinylacetates, ethylene-vinylacetate copolymers, ethylene-propylene rubbers, styrene butadiene rubbers, and silicone rubbers.

The agent-swollen gel of the present invention may be formed in virtually any way that incorporates agent into the polymer in such a manner as to plasticize the same. Exemplary methods include (1) dissolving the polymer and agent with or without a plasticizer in a volatile solent and then allowing the volatile solvent to evaporate; (2) soaking the polymer in agent with or without a plasticizer; and (3) forming the polymer by reaction of appropriate monomers with or without a plasticizer present and then soaking the polymer in agent.

Although the precise form of the gels of the present invention is not important, three forms are conveniently made: (1) non-supported gel; (2) porous media impregnated with gel; and (3) porous media impregnated with agent and coated with agent-swollen gel. The third form has the advantages of (1) having a relatively higher amount of agent since it contains pure agent on the interior of the porous material and (2) being stronger since the porous substrate with gel coating is more rigid than the pure gel form. The agent-swollen gel can be fabricated into any shape desired including beads, chunks, solid fibers, flat sheets, or hollow fibers.

Figure 2:
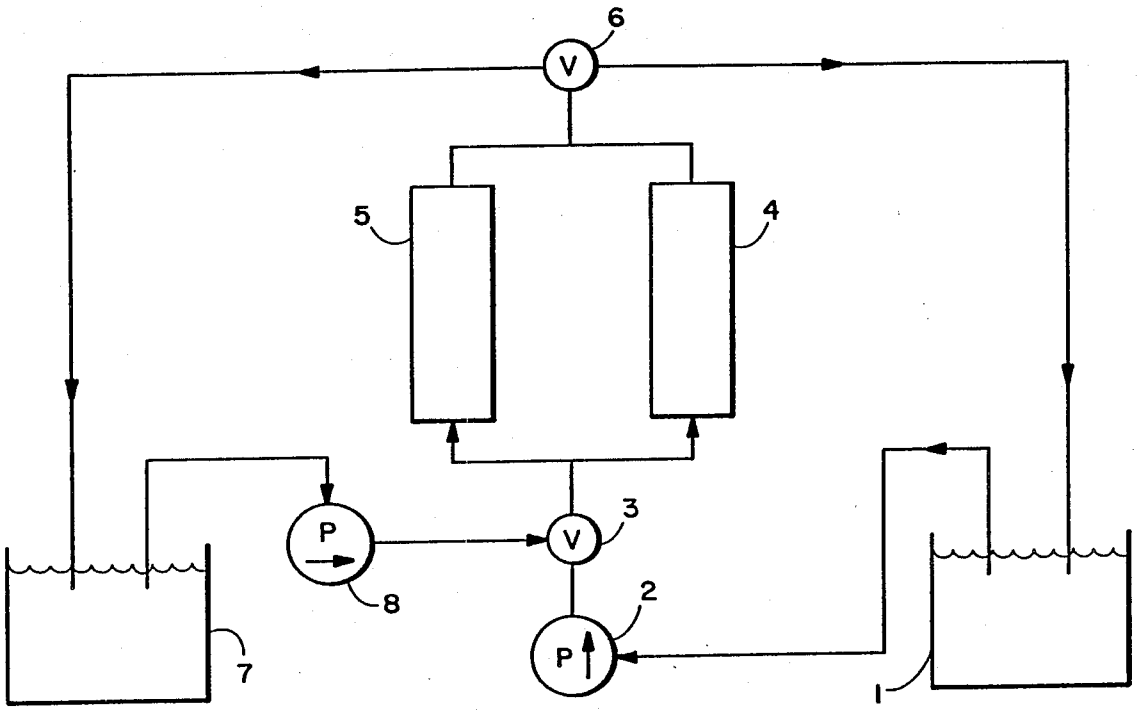
FIG. 2 is a schematic diagram showing an exemplary embodiment of the present invention.

In FIG. 2, a nickel-plating bath 1 is shown connected via a pump 2 and valve 3 to columns 4 and 5, respectively, that, for example, remove copper and zinc and thence by valve 6 back to the bath 1. The stripping solution tank 7 is connected to columns 4 and 5 via pump 8 and valve 3. The columns 4 and 5 are packed with complexing agent-loaded microporous material. By recycling nickel-plating solution through the columns, copper and zinc are extracted from the nickel-plating solution and into the agent-loaded microporous materials. By recycling the stripping solution through the columns, copper and zinc are extracted from the agent-loaded microporous materials and into the stripping solution thereby restoring the copper- and zinc-extracting ability of the agent-loaded microporous material. Depending upon the types of contaminants present in the plating solutions, one or more columns may be used simultaneously for extraction of various metal contaminants.

Loading of the microporous material may be accomplished by any number of suitable means (for example, spraying, soaking, pressurizing or vacuum), so long as the anisotropic material contains approximately 20 to 90% by volume of the complexing agent, preferably about 80%. The preferred method of loading anisotropic microporous media is vacuum loading wherein the material and complexing agent, either alone or with a diluent, are placed under a vacuum of 5 mmHg or less and alternately releasing and applying the vacuum until the pores are substantially filled. The microporous material may be periodically reloaded with complexing agent as the agent is lost to the plating solution.

Stripping metal ions from the complexing agent-loaded microporous material is accomplished generally by contact with a strong acid solution, preferably sulfuric, generally with a pH of less than 2, preferably 0 to 1.

EXAMPLES

Example 1

A few milliliters of 30-vol% 2-hydroxy-5-nonylbenzaldehyde oxime (sold under the trade name Acorga P-5100 by Acorga, Ltd. of Hamilton, Bermuda) in Kermac 470B (a hydrocarbon diluent containing by weight 87% aliphatics and 13% aromatics with a flash point of 93° C. and sold by Kerr-McGee Oil Refining Company of Okalhoma City, Okla.) and about 200 ml of synthetic nickel-plating solution of pH 3.7 that contained 80,000 ppm nickel, 25 ppm copper, and 40 g/L boric acid were placed in a separatory funnel. The funnel was agitated for about 30 minutes to allow extraction of metal ions into the agent solution. The plating solution, now depleted in copper, was replaced with fresh solution and the funnel again agitated for 30 minutes. This process was repeated until apparently no more metal ions were extracted by the agent solution (that is, when the concentration of copper was unchanged after 30 minutes of agitation). The metal ions were then stripped from approximately 1 gram of the loaded agent by contacting it with 50 ml of 100 g/L sulfuric acid in a separatory funnel. At the end of one hour the concentrations of copper and nickel in the strip solution were 360 ppm and 30 ppm, respectively, showing excellent selectivity of the agent for copper over nickel in plating solutions.

Example 2

A few milliliters of 30-vol% di-2-ethylhexylphosphoric acid (DEHPA) in Kermac 470B were placed in a separatory funnel with about 200 ml of the same synthetic nickel-plating solution used in Example 1, with the exception that it contained 25 ppm zinc instead of copper. The funnel was agitated for 30 minutes to allow extraction of the metal ions into the agent solution. The plating solution, now depleted of zinc, was replaced with fresh solution and the separatory funnel again agitated for 30 minutes. This process was repeated until apparently no more metal ions were extracted by the agent solution. The metal ions were then stripped from 1 gram of the loaded agent by contacting it with 50 ml of 100-g/L sulfuric acid in a separatory funnel. The concentrations of zinc and nickel in the strip solution after 2 hours of agitation were 540 ppm and 0.9 ppm, respectively, illustrating outstanding selectivity for zinc over nickel in a plating solution.

Example 3

A few milliliters of 10-vol% DEHPA in Kermac 470B and about 200 ml of synthetic nickel-plating solution that contained 108 ppm iron were placed in a separatory funnel. The funnel was agitated for 30 minutes to allow extraction of the metal ions into the agent solution. The plating solution depleted in iron was replaced with fresh solution and again agitated for 30 minutes. This process was repeated until apparently no more metal ions were extracted by the agent solution. The metal ions were then stripped from 0.079 g of the loaded agent by contacting it with 10 ml of 280-g/L hydrochloric acid in a separatory funnel. The concentrations of nickel and iron in the strip solution after 1 hour of agitation were 60 ppm and 219 ppm, respectively, showing the selectivity of the agent for iron over nickel in a plating solution.

Example 4

Anisotropic microporous material in bead form substantially as shown in FIG. 1 was prepared by injecting (dropwise) a solution of 120 g/L of polysulfone in dimethylformamide through a stainless steel tube with an inside diameter of 0.75 mm into a bath of water at 20° C., thereby precipitating beads 2 to 3 mm in diameter with surface pores less than 0.1 micron in diameter and interior voids of 100 to 200 microns in diameter. The beads were washed with water and allowed to air dry.

Example 5

Beads of Example 4 were loaded with 30-vol% Acorga P-5100 in Kermac 470B. Loading was achieved by submersing 100 ml of beads in 200 ml of the oxime solution and alternately applying and releasing a vacuum of less than 5 mmHg over a period of 2 hours. Four ml of the loaded beads were stirred in 1000 ml of a nickel-plating solution obtained from a metal plating shop; the solution contained 80,000 ppm nickel and 25 ppm copper. After 23 hours the copper concentration was reduced to 12.5 ppm and the nickel concentration was not detectably changed. The beads were then transferred to 50 ml of sulfuric acid having a concentration of 100 g/L for stripping. After 1 hour, the stripping solution contained 247 ppm copper and 35 ppm nickel, showing the selectivity of the loaded beads for copper over nickel in an actual plating solution.

Example 6

Beads of Example 4 were loaded in the same manner as in Example 5 with 30-vol% DEHPA in Kermac 470B. One ml of the so-loaded beads was stirred in 500 ml of a nickel-plating solution from a plating shop that contained about 67,000 ppm nickel and 25 ppm zinc. After 18 hours the concentration of zinc was reduced to 7.0 ppm with no detectable change in the nickel concentration. The beads were then placed in 50 ml of the same stripping solution as in Example 5 for 6 hours, after which the concentration of zinc was 170 ppm and that of nickel 2 ppm, showing the selectivity of the loaded beads for zinc over nickel in an actual plating solution.

Example 7

One ml of beads from Example 4 impregnated with 30 vol% DEHPA in Kermac 470B was placed in 1 L of stirred synthetic nickel-plating solution that contained 80,000 ppm nickel and 10.5 ppm iron at pH 3.6. After 16 hours the concentration of iron in the plating solution was reduced to 3.0 ppm and the concentration of nickel was not detectably changed. The beads were then transferred to 50 ml of stripping solution composed of 5M hydrochloric acid. After 8 hours of stirring the concentration of iron in the solution was 171 ppm and the concentration of nickel was less than 1 ppm, showing the selectivity of the loaded beads for iron over nickel in a plating solution.

Example 8

Four liters of beads from Example 6 were placed in a column and 150 gal of nickel-plating solution was circulated through the column at a flow rate of 3 gal/min and at a temperature of 55° C. The solution initially contained 67,000 ppm nickel and 40 ppm zinc. After circulation through the column for 16 hours, the zinc concentration was 9 ppm and the concentration of nickel was not detectably changed. Five gallons of 100-g/L sulfuric acid stripping solution was then circulated through the column. At the end of 8 hours the solution contained 920 ppm zinc and 85 ppm nickel.

This column was operated on the 150 gallons of nickel-plating solution for 80 days. At the end of that time examination of the beads showed that about 50% of the original charge of agent solution had entered the bath during the test. The quality of the nickel-plating bath was not adversely affected during the 80-day period as indicated by the quality (determined by visual inspection by a plating expert) of the nickel-plated parts produced.

Example 9

Ten ml of anisotropic microporous polysulfone beads were impregnated with the agent solution 30-wt% di-n-dodecyl phosphoric acid in Kermac 470B by submersing the beads in 50 ml of the agent solution and alternatively drawing and releasing a vacuum of about 2 to 4 mmHg four times over 60 minutes and then leaving the beads submerged in the agent solution for another six hours. The beads were removed and excess agent solution was rinsed from the beads with water. One ml of the beads were then placed in a stirred solution of 3 L of actual nickel-plating solution containing 67,000 ppm nickel, 25 ppm zinc, and 40 g/L of boric acid at pH 3.9 for seven hours at 55° C. The beads were then removed, rinsed with water, and placed in 100 ml of 100-g/L sulfuric acid to strip the metal ions from the agent-containing beads. After 15 hours the concentrations of zinc and nickel in the strip solution were 42 ppm and 4 ppm, respectively. Thus, the amount of zinc transferred from the nickel-plating solution to the strip solution was 4.2 g/L of beads, and the amount of nickel transferred from the nickel-plating solution to the strip solution was 0.4 g/L of beads. This corresponds to a selectivity toward zinc over nickel (defined as % zinc/% nickel removed from the plating solution) of about 28,000.

Example 10

The selectivity of the phosphoric acid ester extraction agents of the present invention for zinc in nickel-plating solutions was compared with that of two other well-known zinc extractants, Synex DN (di-nonylnaphthalene sulfonic acid produced by King Industries, Inc., Norwalk, Conn.), and LIX34 8-(alkarylsulfoamide)-quinoline produced by Henkel Chemical Company, Minneapolis, Minn.

A few milliliters of the respective liquid metal-complexing agent solutions (30-vol% DEHPA, Synex DN and LIX 34 in Kermac 470B) and about 200 ml nickel-plating solution from a plating shop that contained 67,000 ppm nickel and 25 ppm zinc were placed in three separatory funnels. The funnels were agitated for about 30 minutes to allow the extraction of the metal ions by the respective agents. The plating solutions (now depleted of zinc) were replaced with fresh solutions and the funnels were again agitated for 30 minutes. This process was repeated until the concentration of zinc after 30 minutes' agitation was still 25 ppm. The metal ions were then stripped from approximately 1 g of each of the loaded agents using three 50-ml portions of 100-g/L $H_2SO_4$, and the metal-ion concentrations in the three solutions measured. The results are presented in the table below. As is apparent, the selectivity of one of the agents of the present invention (DEHPA) for zinc over nickel is many orders of magnitude greater than Synex DN and LIX 34.

| Liquid Metal-Complexing Agent | Zinc Extracted (wt %) g zinc / g agent | Nickel Extracted (wt %) g nickel / g agent | Ratio of Metals Extracted g zinc / g nickel |
|---|---|---|---|
| DEHPA | 2.70 | 0.0045 | 600 |
| Synex DN | 0.0023 | 2.20 | 0.001 |
| LIX 34 | 0.0079 | 0.054 | 0.15 |

Example 11

The impact upon plating quality of the substituted hydroxyoxime liquid metal-complexing agents of the present invention was compared with two well-known copper extractants, Kelex 100 (an alkyl hydroxyquinoline produced by Ashland Chemicals) and LIX 64N (46 wt% to 50 wt% of a β-hydroxybenzophenone oxime and about 1 wt% to 2 wt% of an aliphatic-hydroxy oxime in a kerosene diluent manufactured by Henkel Chemical, Minneapolis, Minn.). The selectivity of each of the agents (Acorga P-5100, Kelex 100 and LIX 64N) was measured in the same manner as in Example 10 except that the plating solution contained 25 ppm copper rather than zinc. Although the selectivity of Kelex 100 and LIX- 64N was slightly better than that of Acorga P-5100, the decontaminated nickel-plating solution that resulted from treatment with Acorga P-5100 exhibited plating quality far superior to the solutions treated with Kelex 100 or LIX64N, as shown below.

The nickel-plating solutions that had been contacted with the three complexing agents were subsequently used for plating. Three batches containing approximately 900 ml of nickel-plating solution and 20 ml of the respective agents (Acorga P-5100, LIX 64N and Kelex 100) were agitated in 1 L separatory funnels for 5 minutes and allowed to settle for about 16 hours. The nickel-plating solutions were then drained into three electrolytic test Hull cells and heated to 55° C. In each of the cells, nickel was plated onto a 8.5×12.5 cm brass test plate using a total current of 3 amps. The cathode and anode were arranged so that the current density ranged from 0.5 to 100 amp/ft$^2$ from edge to edge of the test plate.

Plating quality was assessed by measuring the number of pits per unit area on each of the three test plates in the area of brightest plate (the area corresponding to the current density range from 20 to 30 amp/ft$^2$). The table below compares the pit density of the test plates as well as a control plate made using fresh nickel-plating solution that had not been contacted with an extraction agent. As is apparent, the plating solution contacted with Acorga P-5100 yielded nickel plate with a pit density comparable to that of the control solution, while contact of the plating solution with LIX 64N and Kelex 100 resulted in a much greater pit density.

| Agent Contacted with Nickel-Plating Solution | Pit Density* (pits/cm$^2$) | Amount of Pitting Relative to Control Pit Density (agent) / Pit Density (control) |
|---|---|---|
| Control (no agent) | 1.8 | 1.0 |
| Acorga P-5100 | 1.3 | 0.7 |
| LIX 64N | 11.5 | 6.4 |
| Kelex 100 | 25 | 13.9 |

*Pits counted visually ovre a 9.6-cm$^2$ portion of each plate corresponding to the current density range from 20 to 30 amp/ft$^2$.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. An ion-complexing gel selective to copper ions in a copper ion- and nickel ion-containing solution comprising a hydrophobic nonporous polymer plasticized and swollen with a hydroxyoxime complexing agent of the formula

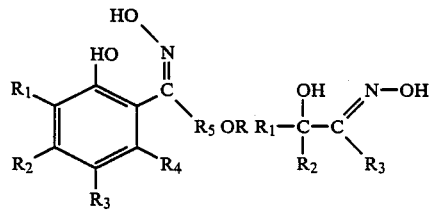

wherein $R_1$ is selected from hydrogen, alkyl, aryl and CH=N—OH; and $R_2$, $R_3$, $R_4$ and $R_5$ are selected from hydrogen, alkyl and aryl.

2. The gel of claim 1 wherein said hydroxyoxime complexing agent is selected from 2-hydroxy-5-alkyl benzaldehyde oximes; 2-hydroxy-alkylbenzophenone oximes; 2,6-diformyl-4-alkylphenol dioximes; and 5,8-diethyl-7-hydroxy-dodecane-6-one oxime.

3. An ion-complexing gel selective to zinc and iron ions in a zinc ion-, iron ion- and nickel ion-containing solution comprising a hydrophobic nonporous polymer plasticized and swollen with a phosphoric acid ester complexing agent of the formula

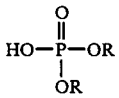

wherein R is selected from hydrogen, alkyl and aryl and at least one R is alkyl or aryl.

4. The gel of claim 3 wherein said phosphoric acid ester is selected from di-2-ethylhexyl phosphoric acid, di-2-ethyloctyl phosphoric acid, di-iso-decyl phosphoric acid, di-n-decyl phosphoric acid, di-alkylphenyl phosphoric acid, and di-(3,7-dimethyloctyl) phosphoric acid.

5. The gel of claim 1 wherein said polymer has been polymerized in the presence of said complexing agent.

6. The gel of claim 1 wherein said polymer has been plasticized and swollen with said complexing agent in the presence of an organic solvent.

7. The gel of claim 1 wherein said polymer is selected from one or more of alkyl-, aryl-, halogen- and amino-substituted polyethylenes, polypropylenes, polyacrylics, polyacrylates, polymethacrylates, polyurethanes, polyamides, polyetherimides, polyvinylbutyrals, polyacrylonitriles, polynorborenes, polyvinyl ethylene-vinylacetate copolymers, ethylene-propylene rubbers, styrene butadiene rubbers, and silicone rubbers.

8. The gel of claim 1 contained within the pores of or coated onto solid microporous support media selected from beads, fibers and sheets.

9. The gel of claim 1 coated onto a solid microporous support, said support itself containing said complexing agent.

10. An ion-complexing medium selective to copper ions in a copper ion- and nickel ion-containing solution comprising polymeric microporous anisotropic beads having surface pores less than 0.1 micron in diameter and interior voids from about 10 microns to about 200 microns in diameter, said beads being impregnated with a nonpolymerizable hydroxyoxime complexing agent of the formula

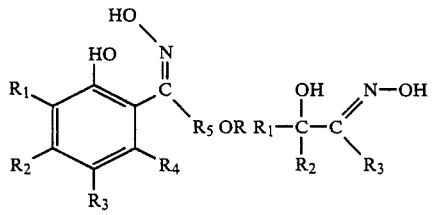

wherein $R_1$ is selected from hydrogen, alkyl, aryl and CH=N—OH; and $R_2$, $R_3$, $R_4$ and $R_5$ are selected from hydrogen, alkyl and aryl.

11. The ion-complexing medium of claim 10 wherein said hydroxyoxime complexing agent is selected from 2-hydroxy-5-alkyl-benzaldehyde oximes; 2-hydroxy-alkylbenzophenone oximes; 2,6-diformyl-4-alkylphenol dioximes; and 5,8-diethyl-7-hydroxy-dodecane-6-one oxime.

12. An ion-complexing medium selective to zinc and iron ions in a zinc ion-, iron ion- and nickel ion-containing solution comprising polymeric microporous anisotropic beads having surface pores less than 0.1 micron in diameter and interior voids from about 10 microns to about 200 microns in diameter, said beads being impregnated with a nonpolymerizable phosphoric acid ester complexing agent of the formula

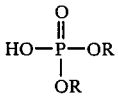

wherein R is selected from hydrogen, alkyl and aryl and at least one R is alkyl or aryl.

13. The ion-complexing medium of claim 12 wherein said phosphoric acid ester complexing medium is selected from di-2-ethylhexyl phosphoric acid, di-2-ethyloctyl phosphoric acid, di-iso-decyl phosphoric acid, di-n-decyl phosphoric acid, di-alkylphenyl phosphoric acid, and di-(3,7-dimethyloctyl) phosphoric acid.

14. The gel of claim 3 wherein said polymer has been polymerized in the presence of said complexing agent.

15. The gel of claim 3 wherein said polymer has been plasticized and swollen with said complexing agent in the presence of an organic solvent.

16. The gel of claim 3 wherein said polymer is selected from one or more of alkyl-, aryl-, halogen- and amino-substituted polyethylenes, polypropylenes, polyacrylics, polyacrylates, polymethacrylates, polyurethanes, polyamides, polyetherimides, polyvinylbutyrals, polyacrylonitriles, polynorborenes, polyvinyl ethylene-vinylacetate copolymers, ethylene-propylene rubbers, styrene butadiene rubbers, and silicone rubbers.

17. The gel of claim 3 contained within the pores of or coated onto solid microporous support media selected from beads, fibers and sheets.

18. The gel of claim 3 coated onto a solid microporous support, said support itself containing said complexing agent.

* * * * *

UNITED STATES PATENT AND TRADEMARK OFFICE

CERTIFICATE OF CORRECTION

PATENT NO. : 4,876,287

DATED : Oct. 24, 1989

INVENTOR(S) : Walter C. Babcock; Dwayne T. Friesen

It is certified that error appears in the above-identified patent and that said Letters Patent is hereby corrected as shown below:

| | | |
|---|---|---|
| Col. 1, | Line 65: | Change "bath-" to --bath--. |
| Col. 2, | Line 32: | Change "temperathure" to --temperature--. |
| Col. 2, | Line 59: | Change "plsticized" to --plasticized--. |
| Col. 5, | Line 14: | Change "solent" to --solvent--. |
| Col. 9, | Line 66: | Change "ovre" to --over--. |

Signed and Sealed this

Thirtieth Day of July, 1991

*Attest:*

*Attesting Officer*

HARRY F. MANBECK, JR.

*Commissioner of Patents and Trademarks*